US005562026A

United States Patent [19]

Hennig

[11] Patent Number: 5,562,026

[45] Date of Patent: Oct. 8, 1996

[54] METHOD FOR THE HYDRAULIC CONTROL OF AN ARTICULATED OR TOGGLE-LEVER PRESS AND ARTICULATED OR TOGGLE-LEVER PRESS HAVING A CONTROL ADAPTED FOR CARRYING OUT THE METHOD

[75] Inventor: Jürgen Hennig, Biebergemünd, Germany

[73] Assignee: Leinhaas Umformtechnik GmbH, Gelnhausen, Germany

[21] Appl. No.: 217,043

[22] Filed: Mar. 23, 1994

[30] Foreign Application Priority Data

Mar. 23, 1993 [CH] Switzerland ..... 870/93
Jul. 28, 1993 [CH] Switzerland ..... 2277/93

[51] Int. Cl.[6] ..... B30B 1/16

[52] U.S. Cl. ..... 100/35; 72/373; 72/453.03; 83/13; 83/639.1; 100/272

[58] Field of Search ..... 100/35, 272, 286; 72/373, 451, 453.03; 83/13, 630, 639.1

[56] References Cited

U.S. PATENT DOCUMENTS 1,007,792 11/1911 Orton ..... 100/272
2,780,117 2/1957 Bauer et al. ..... 100/272
4,303,012 12/1981 McGlennon ..... 100/272

*Primary Examiner*—Stephen F. Gerrity

[57] ABSTRACT

A method for hydraulic control of a toggle lever press in which the velocity of a driving piston rod is increased at least once in the working region of a press ram. The velocity of the press ram is thus kept relatively constant up to bottom dead center (or upper dead center) of the press ram. A toggle lever press has a control adapted for carrying out this method.

12 Claims, 9 Drawing Sheets

METHOD FOR THE HYDRAULIC CONTROL OF AN ARTICULATED OR TOGGLE-LEVER PRESS AND ARTICULATED OR TOGGLE-LEVER PRESS HAVING A CONTROL ADAPTED FOR CARRYING OUT THE METHOD

BACKGROUND OF THE INVENTION

1. Field of the Invention

The invention relates to a method for the control of an articulated or toggle-lever press and an articulated or toggle-lever press controlled by the method.

2. Discussion of Prior Art

Such methods are used in particular in cutting and forming presses of modern design with hydromechanical toggle-lever drives. The Applicant has successfully introduced into the market, for example under the name differential travel press (DTP), a toggle-lever sheet metal cutting press which is described, for example, in German Patent Document 2925416 or EP-A1 250610. The descriptions and drawings in the above identified Patent Documents of the parts toggle-lever arrangement (individual or a plurality in parallel) and support thereof on the press frame and support of the working cylinder on the press ram are regarded as being disclosed herein for the purpose of the design of an embodiment.

Such a press has two toggle lever systems whose toggle joints bend outward toward the center of the press which are activated by a piston rod of a cylinder/piston arrangement arranged symmetrically with respect to the toggle levers, during a cycle in the forward direction and subsequently in the backward direction. The market is also familiar, although to a lesser extent, with a press which was introduced as a differential pressure press (DPP) and has a further rod system guided in roller rails, between the piston rod and the coupling points on the toggle levers. Such a press was presented to the public in August 1987 and subsequently brought into use.

The origins of both known presses are to be found in a toggle-lever press having a crank drive which operated the toggle levers in order further to reduce the velocity of the press ram in the region of the bottom or upper (depending on whether the working region was at the bottom or top) dead center and to keep it as slow as possible over a certain period or over a certain distance. This is because it was possible to achieve more precise cutting or machining quality when cutting or stamping or drawing the material to be machined, than in the case of a straight-forward crank drive without intermediate toggle levers. In addition, it was possible correspondingly to increase the force in the working range (cutting range) by means of the transmission effect of the toggle levers.

The toggle levers also ensure in particular the precision in the cutting direction (cutting depth), which was also utilized, inter alia, in the case of the toggle-lever presses with a hydraulic piston drive, as shown, for example, in GB-A 707815.

Although attention was focused earlier in particular on obtaining the stated velocity reduction in the working range and subsequently on improving the cutting precision, with increasing automation of the production processes the working velocity (number of strokes) as well as very high precision were forced into the forefront. The differential travel press achieved this through a combination of the advantages of an eccentric press (rapid continuous running) with those of a hydraulic press (pressure control and velocity variation) and those of a toggle-lever press (high forces in the working range and very high precision with regard to the cutting depth). The differential pressure press subsequently constructed on the basis of the differential travel press attempted to increase the number of strokes of the press by additional mechanical means comprising roller rails and an intermediate rod system, or this was achieved in an expensive manner by means of the additional components subjected to considerable wear.

SUMMARY OF THE INVENTION

Accordingly, it is the object of the present invention to provide a press and a simple method for driving said press, so that, without loosing the particular advantages and characteristics of the known presses, a larger number of strokes and therefore greater profitability are permitted. The additionally required components for the control should be kept to a minimum, not least in order to avoid the control time lag and control errors. On the other hand, a conventional differential travel press or differential pressure press should be improved in such a way that it is possible to set a desired forming velocity which remains essentially constant over the entire forming process, with the result that the optimum forming velocity is achieved per workpiece. This object, too, should be permitted without substantial additional expense with regard to control means (due to a large number of additional components for controllers or the like).

Keeping the velocity of the press ram as constant as possible over the entire working range (from contact for cutting the workpiece to the backward movement of the ram) is already known in principle in the case of other hydraulic press types. However, this generally requires large hydraulic drives since, without the advantageous action of the toggle levers, which is not present in the known presses, said drives have to apply both the working pressure and the considerable oil flow rate for movement at high velocity. However, high oil flow rates also mean large cross-sections of the pressure lines or increased flow velocities and hence lower efficiency of the press generally and frequently even a higher cutting noise.

Such a comparable hydraulic press is described, for example, in DE-A 4036564, which, however, does not aim at a constant ram velocity but might permit this with an appropriate design. For controlling important process parameters, such as distances (s), velocity (v) and forces (F), an expensive 4/5-way control valve with certain peripheral units, electronic position sensors, pressure sensors and finally even an electronic control are required there.

In the case of articulated or toggle-lever presses, this aim is also novel and actually exactly the contrary of the teaching to date, which in fact states that a permanent reduction in the velocity of the press ram in the working range was actually desirable, or the effect of the toggle levers is utilized for velocity reduction. The objects of the invention are achieved by a method for control of a piston rod of a working cylinder of a toggle lever system in a toggle lever press comprising reducing velocity and increasing compressing force of a press ram prior to reaching a contact point at which a tool driven by the press ram contacts a work piece; and, increasing forward moving velocity of the piston rod at least once after the contact point is reached and before initiation of backward movement of the piston rod. A toggle press that performs the method of the invention has a controlled cylinder and piston arrangement in which the toggle lever system is hydraulically controlled.

By means of the method according to the invention, the slowing-down effect caused by the toggle levers in the working range is partly weakened or compensated by virtue of the fact that the crank velocity in the working range is varied according to the invention and advantageously.

The objects were not achieved by other designs, which however appeared to look for similar solutions:

Thus, U.S. Pat. No. 3,926,033 describes a "series circuit" of cylinder/piston arrangements (telescopic cylinder) with different effective areas, which once again have to be operate&, in a disadvantageous manner, with correspondingly large, efficient hydraulic drives. Switching specifically from one piston to another within a movement phase is not possible.

On the other hand, the invention achieves the required objects in a simple manner. In principle, the invention can be used for any conventional hydraulically operated articulated or toggle-lever press. The only condition is that the drive of the piston rod is velocity-controlled.

By means of the method according to the invention, the ram velocity is not reduced as in the past (for example in the case of the differential travel press or differential pressure press) up to the bottom dead center but instead is kept almost constant, at the expense of the drive force of the piston rod. This can be accepted owing to the kinetics of the toggle lever principle which, owing to its increasing transmission in the region of the bottom dead center (working range), in any case requires only a part of the drive force which was still required further above the bottom dead center in order to apply the press force required for deformation. If a workpiece is also cut with an arrangement according to the invention, the effect according to the invention is particularly appropriate for the workpiece: only on initial contact of the cutting tool with the workpiece are high forces used; in the flow range, these generally decrease.

Advantageously, the invention does not change other desired characteristics of a differential travel press or differential pressure press, such as, for example, stopping times of less than 50 ms, practically no cutting noise owing to oil under high pressure, long tool lives, possibility of subsequent pressure adjustments in the region of the bottom dead center, lack of necessity of dampening the cutting shock, etc. However, the invention can be realized by the simplest hydraulic circuits. Compared with the known circuit according to DE-A1 4036564, the embodiments shown indicate that a minimum of mechanical hydraulic control is sufficient for the invention.

However, a preferred embodiment of a press according to the invention is equipped with at least one stacked piston cylinder or differential cylinder with integrated plunger cylinder as the main working drive source. Together with the method according to the invention, this structure has the advantage of considerable compactness and a reduction of seal problems compared with arrangements comprising a plurality of drive cylinders having different pressure surfaces acting parallel to one another. A further advantage of this preferred solution is that it is possible to work with high pressures but low oil flow rates, resulting in high hydraulic efficiency.

The apparatus claims each refer to the velocity of the piston rod. Of course, the scope of the invention also covers variants whose toggle levers are driven not directly by a piston rod but, for example, by an electromechanical drive. In such cases, the piston rod is also to be understood only as a pressure piece which directly engages the toggle levers.

From the point of view of the basic principle, the method according to the invention is concerned with the control of a press ram of a hydromechanical toggle-lever press in its operating range. As mentioned, the basic concept is to keep the operating velocity of the ram in this range as constant as possible at the velocity recognized as being optimal, which it has reached at the time of the first cutting contact (at the beginning of the operating range). For each material or workpiece, there is an optimum forming velocity which is chosen according to the invention and remains essentially constant during the forming process. However, it is also in the scope of the invention to increase the piston rod velocity after the cutting point has been reached so that, after deflection of this velocity by the toggle lever or toggle levers, there is even an increase in the ram velocity if this is desirable for the relevant workpiece, for example for reasons relating to shaping technology.

As a rule, all switching and control processes may take place stepwise, but, for special embodiments, said processes may also be continuous, optionally even electronically controlled, for example with the use of the expensive controller circuit according to DE-A 4036564, whose detailed circuit structure is considered to have been disclosed for the purposes of this Application, optionally even by the method, which is not preferred, of hydraulic pumps which are overdimensioned or connected in parallel and which, by increasing their delivery, might also be used for accelerating the piston rod in the operating range of the ram.

However, purely mechanical forced control of the valves as a function of the travel of the piston rod is preferred, since this makes it possible to achieve the maximum numbers of strokes. The principle of the differential piston shown in the drawing can of course also be used in various ways in the invention for increasing the number of steps, provided that the cylinder/piston arrangement is appropriately chosen.

The two cylinder systems thus supplement one another optimally from the point of view of minimizing hydraulic oil consumption in combination with good press performances. Together with the method according to the invention (optionally with the aid of a differential piston), such a variant also operates faster than in the past.

BRIEF DESCRIPTION OF THE DRAWINGS

Further examples are evident from the figures and the description thereof, in which.

DETAILED DESCRIPTION OF PREFERRED EMBODIMENTS

Figure 1:
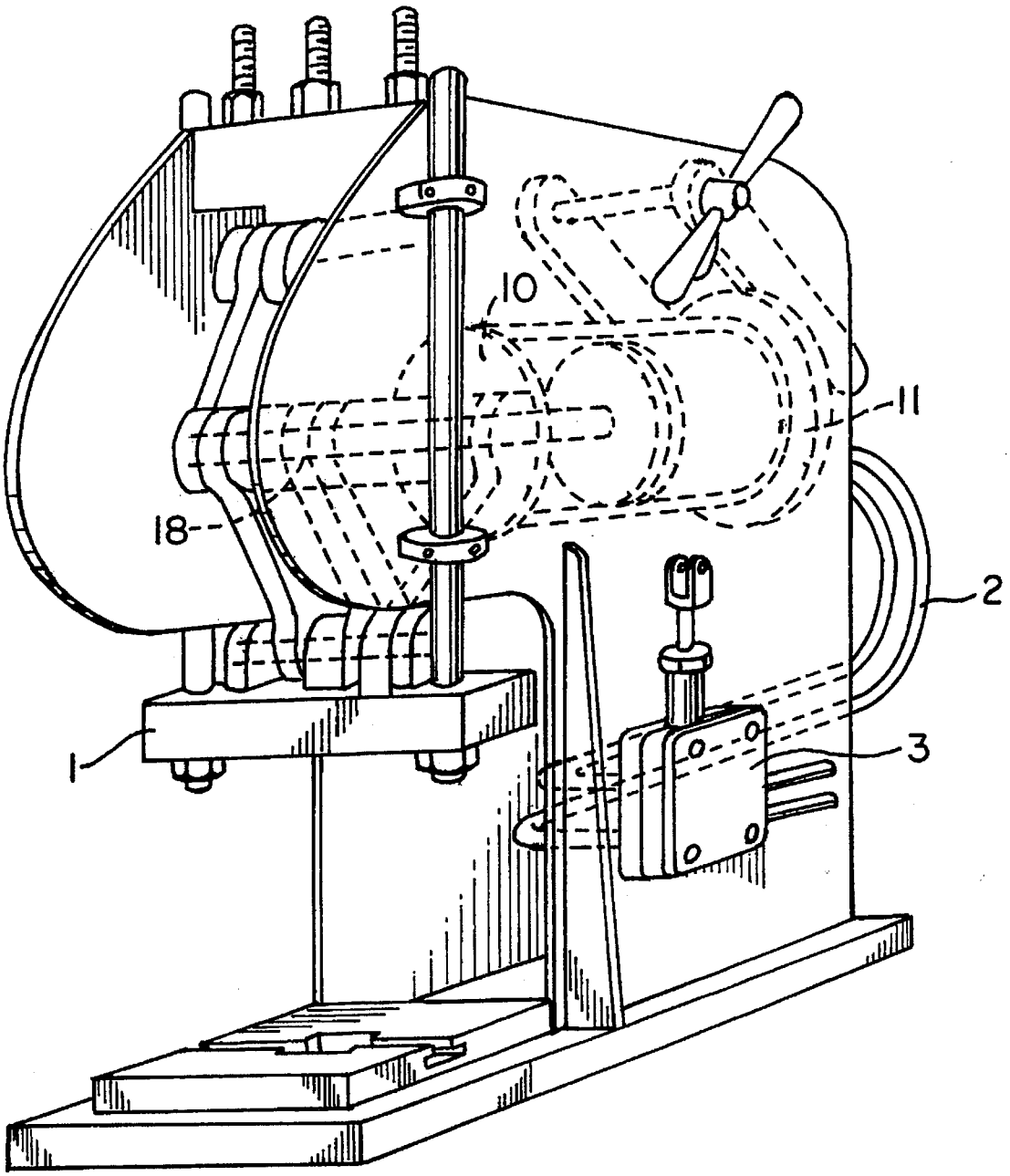
FIG. 1 PRIOR ART
FIG. 1 shows an example of a known toggle-lever press having a simple drive cylinder (with large dimensions) which can be controlled in accordance with the method according to the invention by means of a control not shown in detail.

FIG. 1 shows a toggle-lever press whose structure is described in detail in GB-A-707815 (corresponding parts of the description are regarded as being disclosed herein). The press ram 1 is driven by the toggle lever arrangement 18, which is driven by a cylinder/piston arrangement 10, 11. This arrangement is controlled via pressure lines 2 by a hydraulic control 3. The control operates by the principle according to the invention. In the region of the bottom dead center, the oil flow rate is increased and the piston 10 is correspondingly accelerated so that the press ram 1 has approximately a constant working velocity in the working range.

Figure 2:
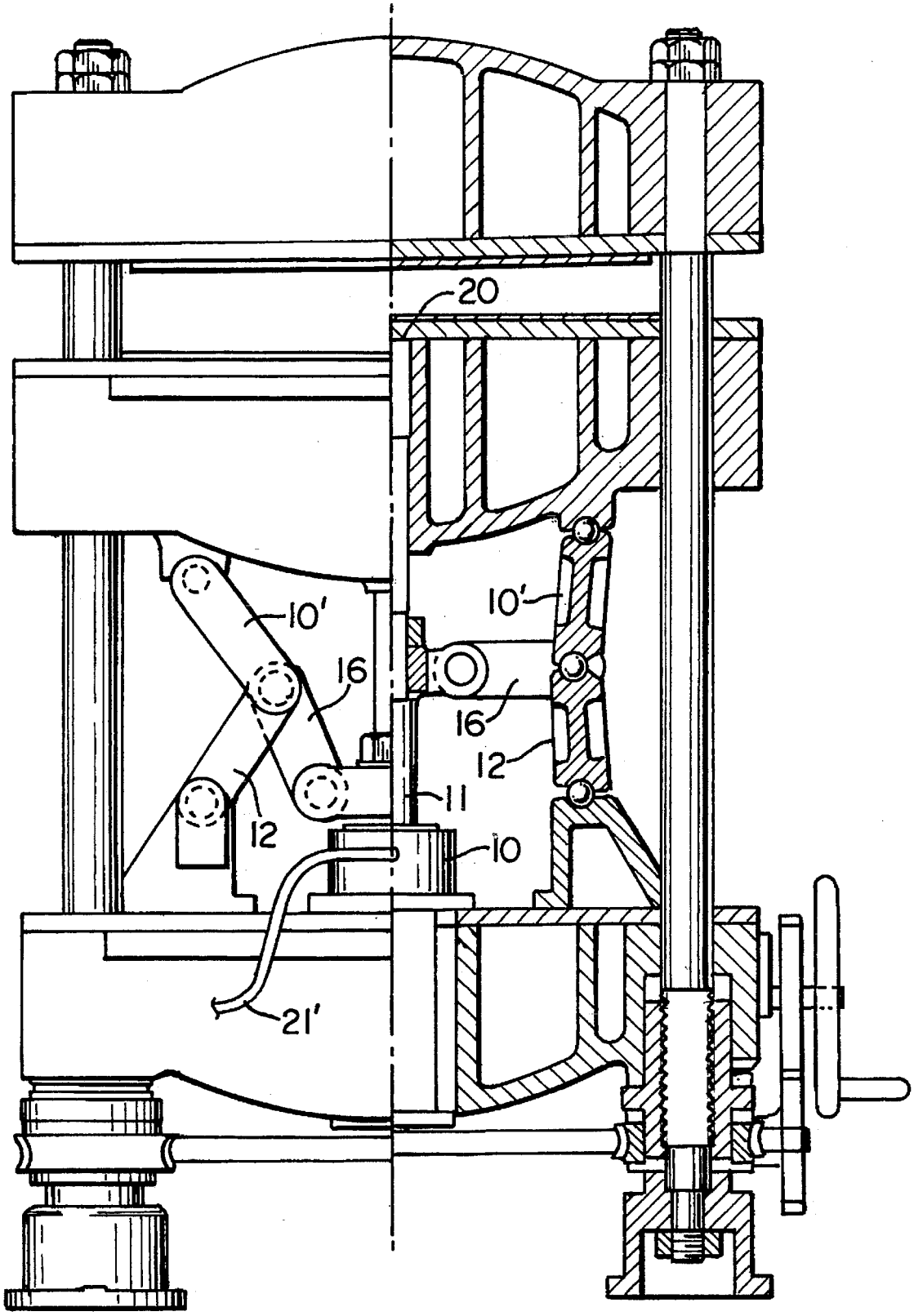
FIG. 2 PRIOR ART
FIG. 2 shows a variant having two symmetrically arranged toggle levers which are engaged by a differential cylinder/piston arrangement which is modified according to the invention but not shown in detail and which is connected to a control which is not shown and operates in accordance with the method according to the invention.

FIG. 2 shows a press having two complementary toggle lever systems 10, 12, 16 which are driven by a cylinder/piston arrangement 10, 11. The latter is supplied with compressed air or another pressure medium similarly to the press according to FIG. 1, via a control line 21. The remaining structure of this press is described in detail in U.S. Pat. No. 804,352, which is considered to be disclosed herein. The press ram 20 of this press operates from bottom to top. The meaning, according to the invention, of the bottom dead center is therefore to be understood here for the upper dead center.

Figure 3:
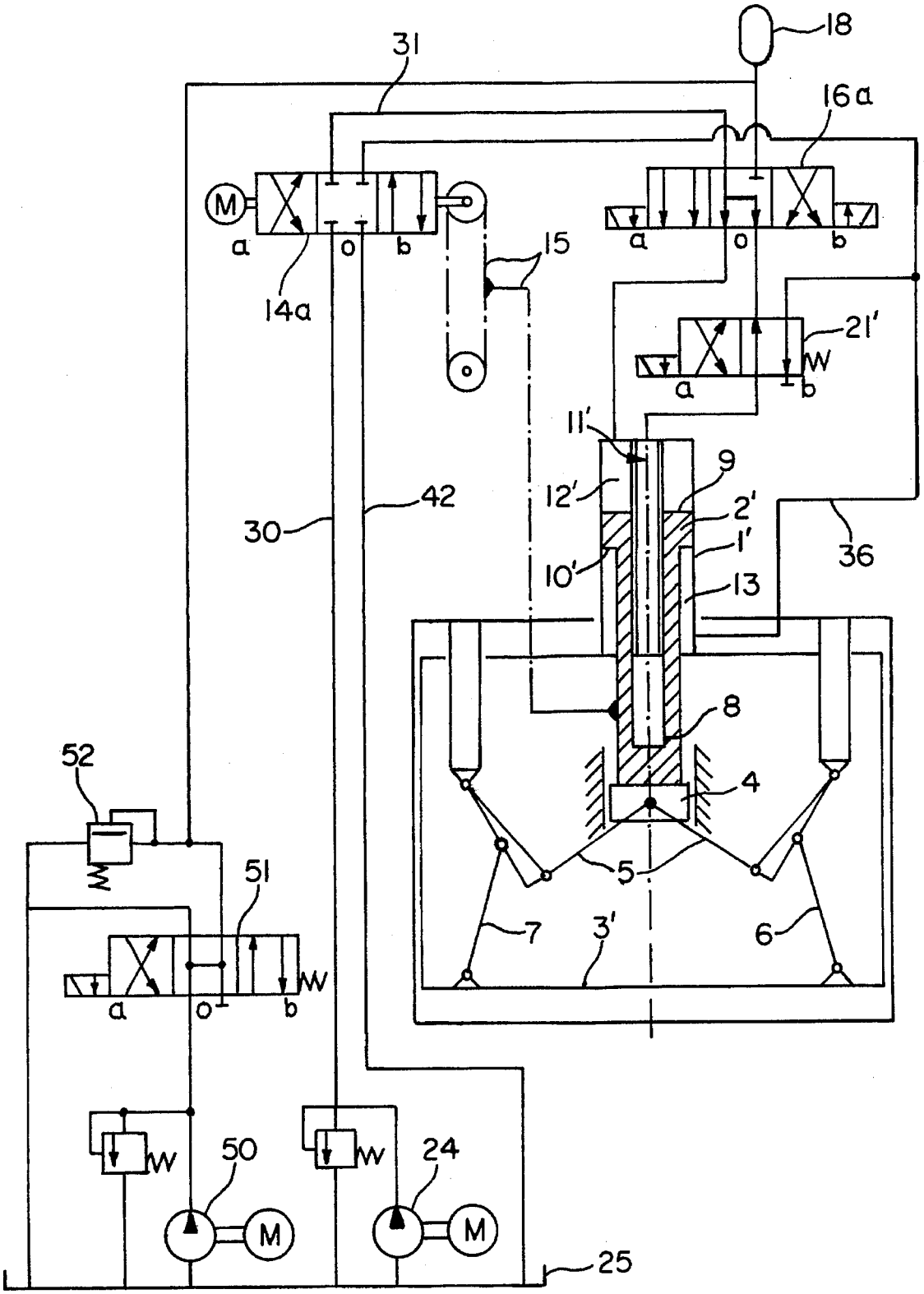
FIG. 3 shows a schematic view of a variant of a differential travel press having a hydraulic circuit which has a differential circuit for the differential cylinder to ensure better utilization of the flowing oil volumes.

The press according to FIG. 3 differs from that according to FIGS. 1 and 2 in that the working cylinder 1 is supported not on housing G but on ram 3, and the press thus corresponds to a differential travel press. The detailed structure of such a press is described, for example, in EP-A1 250610.

The further details according to the invention of the structure are as follows: A pump delivers hydraulic oil through a hydraulic line 30 to a cam-operated 3-position valve 14*a* which, in its position b, transports the oil into a line 31. The cam control is coupled to the piston position and indicated symbolically by 15. The hydraulic oil is transported from the line 31 via the 3-position valve 16*a* in its position a and via the 2-position valve 21 in its position b into the innermost piston space 11. Since this has a relatively small volume, the result is a relatively rapid downward movement of the piston 2 and hence, via the thrust member 4 and the toggle levers 5, 6, 7, a rapid downward movement of the ram 3. The cylinder space 13 is simultaneously emptied via the line 36, the latter being emptied via valve 14*a* (position b) into the storage container 25.

Oil can flow simultaneously from the accumulator 18 at atmospheric pressure and in sufficient quantity into the cylinder space 12 without braking the feed velocity of the piston 2.

Figure 7:
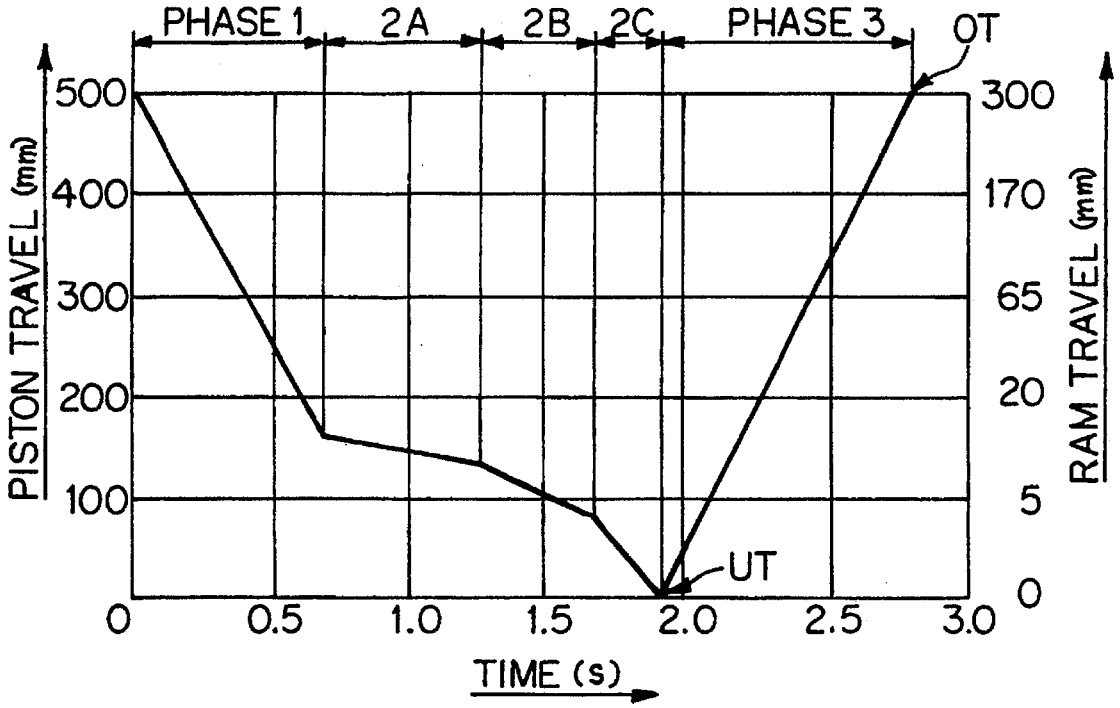
FIG. 7 shows a symbolic distance/time curve of a press according to the invention; the stroke is 300 mm. and the cutting distance is 15 mm.
Figure 8:
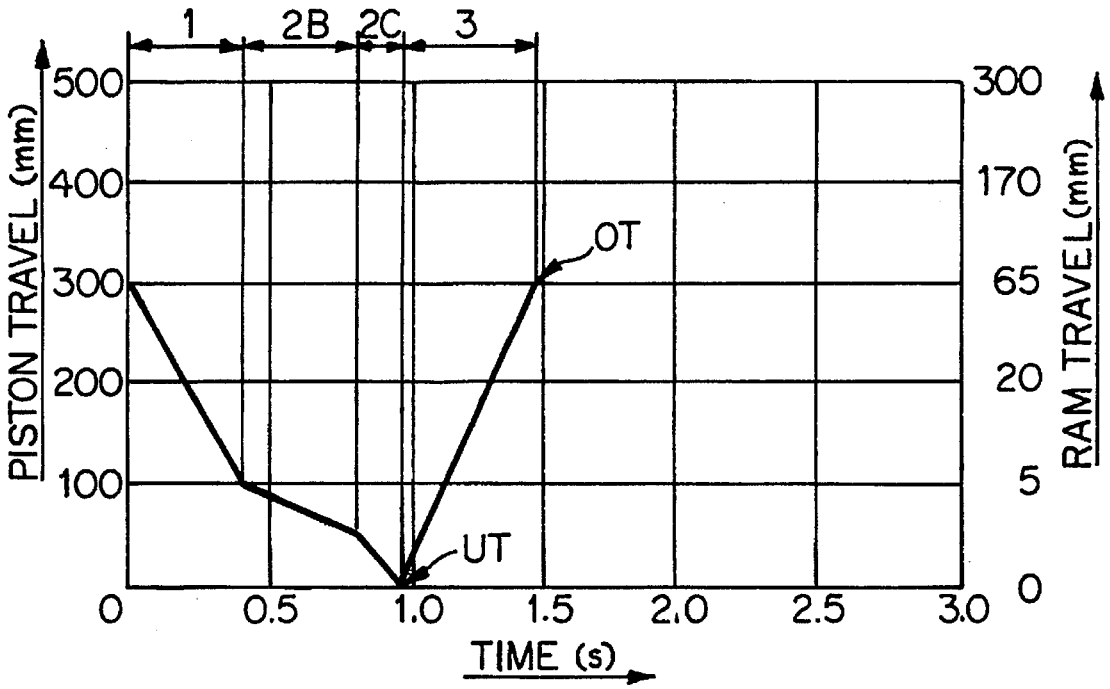
FIG. 8 shows another distance/time curve for a press of different design; the stroke is 65 mm. and the cutting distasnce is 5 mm.
Figure 9:
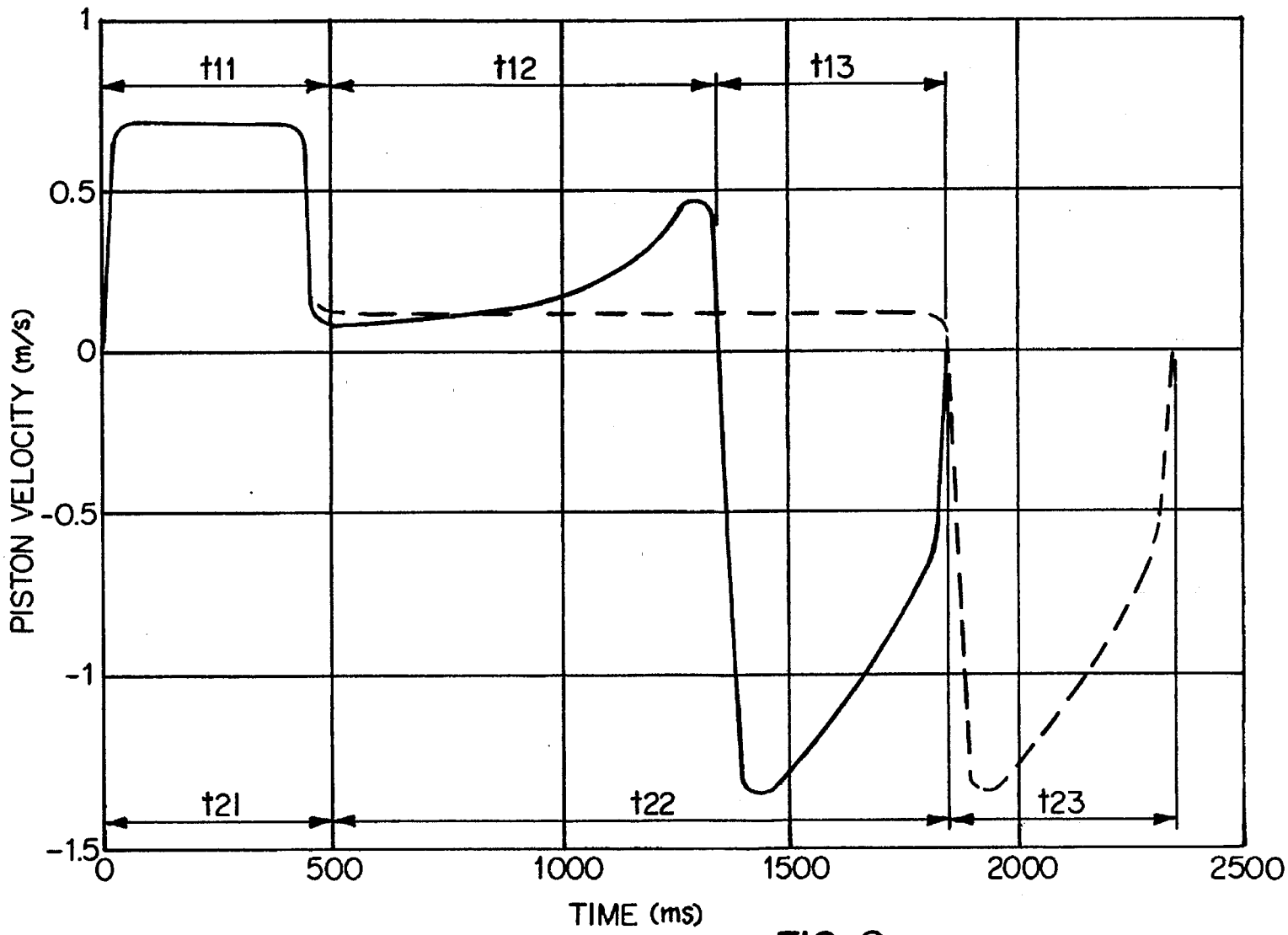
FIG. 9 shows the schematic velocity/time curve of the piston rod for comparing a conventional single-step cylinder (shown as a broken line) with a multi-step cylinder (shown as a solid line) according to the invention and FIG. 10 shows a corresponding comparison of curves for the press ram.
Figure 10:
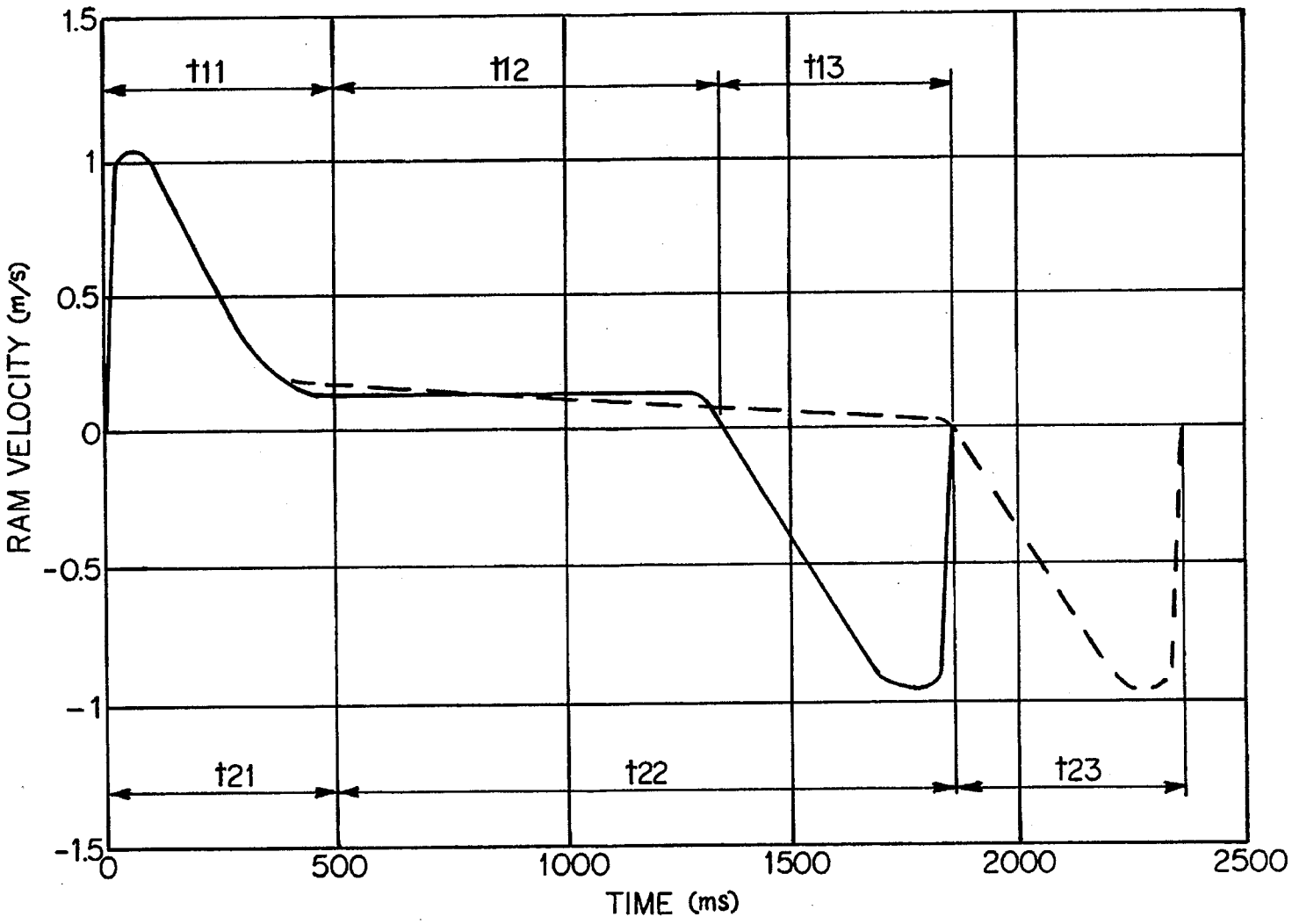

By changing over the valve 16*a* to its position 0 (phase 2A), hydraulic oil is then delivered, beginning with phase 2 (cf. FIG. 7), from the line 31 into both cylinder spaces 11 and 12, with the result that the nominal working pressure for the ram 3 is applied. The feed velocity of the piston rod 2 is now at its lowest and its force is at the maximum.

By changing over the valve 16*a* to its position b (phase 2B), hydraulic oil is delivered only into the cylinder space 12. Oil at atmospheric pressure enters the cylinder space 11 from the accumulator 18. The velocity of the piston rod 2 is thus increased again and the velocity of the ram 3 is not reduced.

Changing over valve 16*a* once again to its position a results in phase 2C in which hydraulic oil is once again delivered only into the cylinder space 11, with the result that the piston rod is further accelerated and the reduction of the ram velocity—caused by the toggle lever effect—is compensated.

After reaching the bottom dead center, the valve 16*a* switches to position a and valve 14*a* to its position a, with the result that the hydraulic oil is transported from the line 30 into the line 36 and from there to the annular cylinder space 13 under a pressure which rapidly moves the piston 2 upward. Initially, the pressure required for this purpose is still small since the toggle lever transmission provides assistance. At the same time, the valve 16*a* switches to its position a, with the result that the oil from the space 12 can flow into the accumulator 18 and the oil from the space 11 can flow via the valve 14*a* into the line 42 or the container 25.

Summary of the sequence of control at valve 16*a:*

Phase 1 (rapid forward movement of the press ram to the beginning of the working range—cutting point): position a;

Phase 2A (braked movement with greatest hydraulic force at the piston rod 2): position 0;

Phase 2B (first increase in the piston velocity with simultaneous reduction in compressive force): position b;

Phase 2C (second increase in the piston velocity with further reduction in the compressive force): position a;

Phase 3 (accelerated backward movement of the ram): position a

Toward the end of phase 3, possibly position 0 again.

If the effective piston area of the plunger cylinder 8 is chosen to be smaller than the effective piston ring area 10, a differential circuit can be used for the backward movement (upward in phase 3) between these two surfaces. Valve 21 is used for this purpose and has the following functions:

Position a: Differential, system between surface 8 and surface 10; the oil volume transported back from the cylinder space 11 is delivered directly into the space 13, which increases the oil flow rate and thus accelerates filling.

Position b: Direct system

The differential system can be effectively used at the beginning of phase 3 because it is there that the transmission ratio between thrust member 4 and ram 3 is large (small force requirement at piston rod 2). With decreasing transmission ratio, it is necessary to change over to the direct system (valve 21 in position b). By means of the differential system, it is thus possible to accelerate phase 3 at the beginning, which permits a further increase in the number of strokes, especially since the time for the backward movement advantageously decreases. Furthermore, this technical solution could be used in simpler variants of the invention as an independent solution, regardless of the use.

The container 18 shown as an accumulator reduces the relief problems of the hydraulic oil during the change from the pressureless to the pressurized state. As a rule, however, it will only have a pressure which is small compared with the working pressure in the cylinder and—as illustrated in other examples (for example FIG. 4)—may even be replaced by a straight-forward top-up container at ambient pressure.

A small amount of oil is continuously transported into the accumulator 18 by means of the pump 50 and valve 51 (FIG. 3; position a). This ensures that an exchange of oil takes place between accumulator 18 and container 25.

Figure 4:
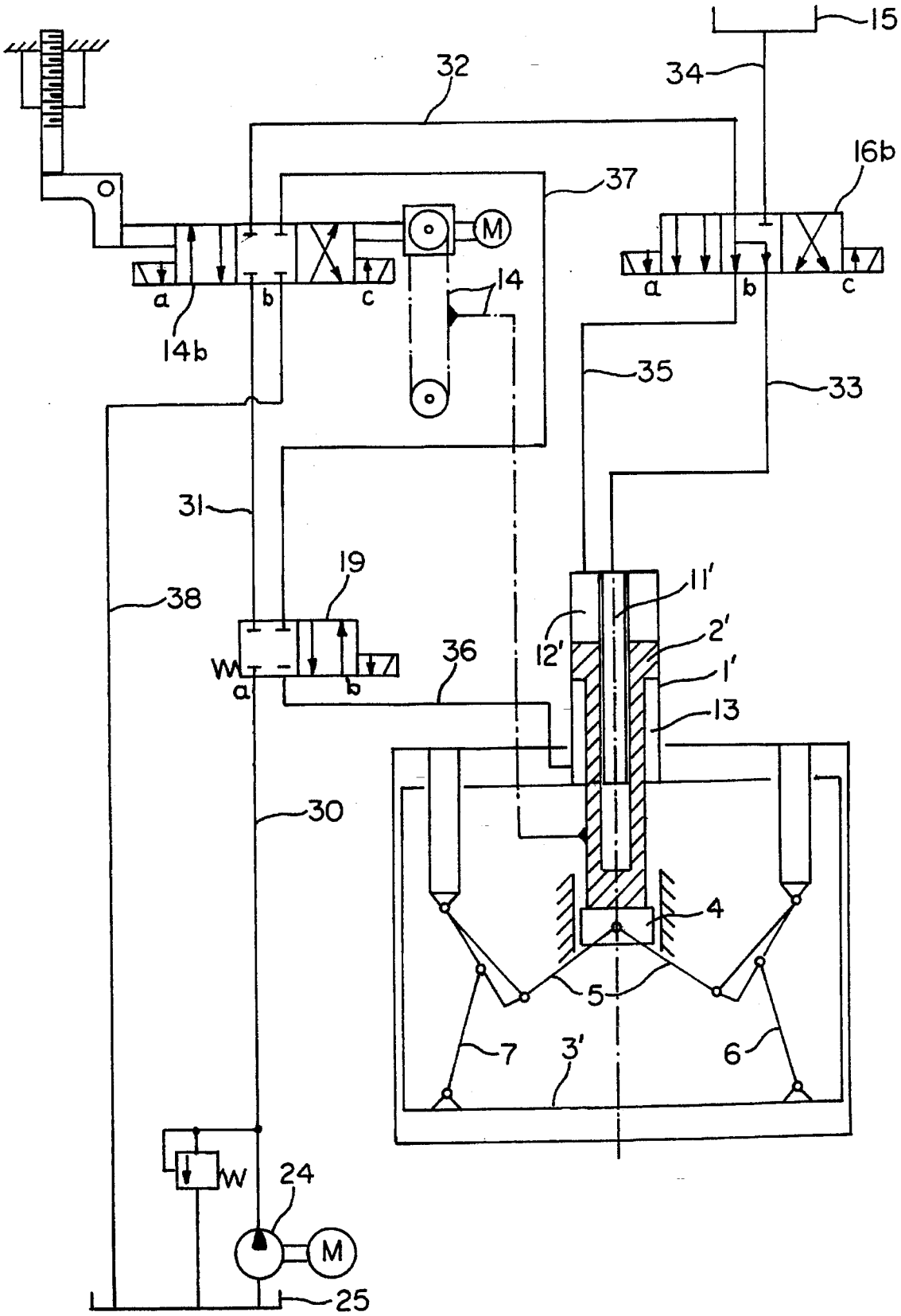
FIG. 4 shows a variant without a differential circuit for the differential cylinder.
Figure 5:
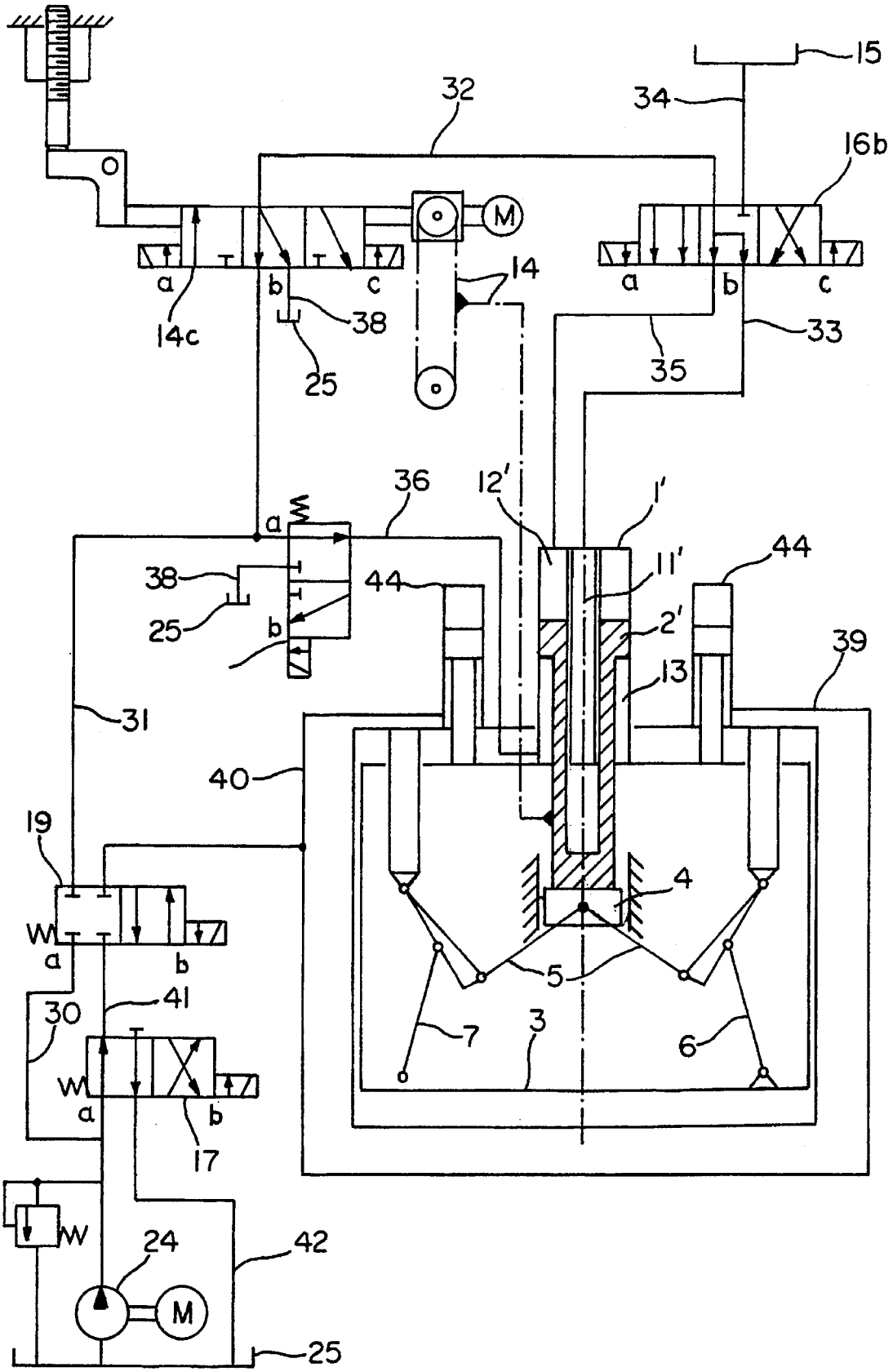
FIG. 5 shows a variant having auxiliary working cylinders.
Figure 6:
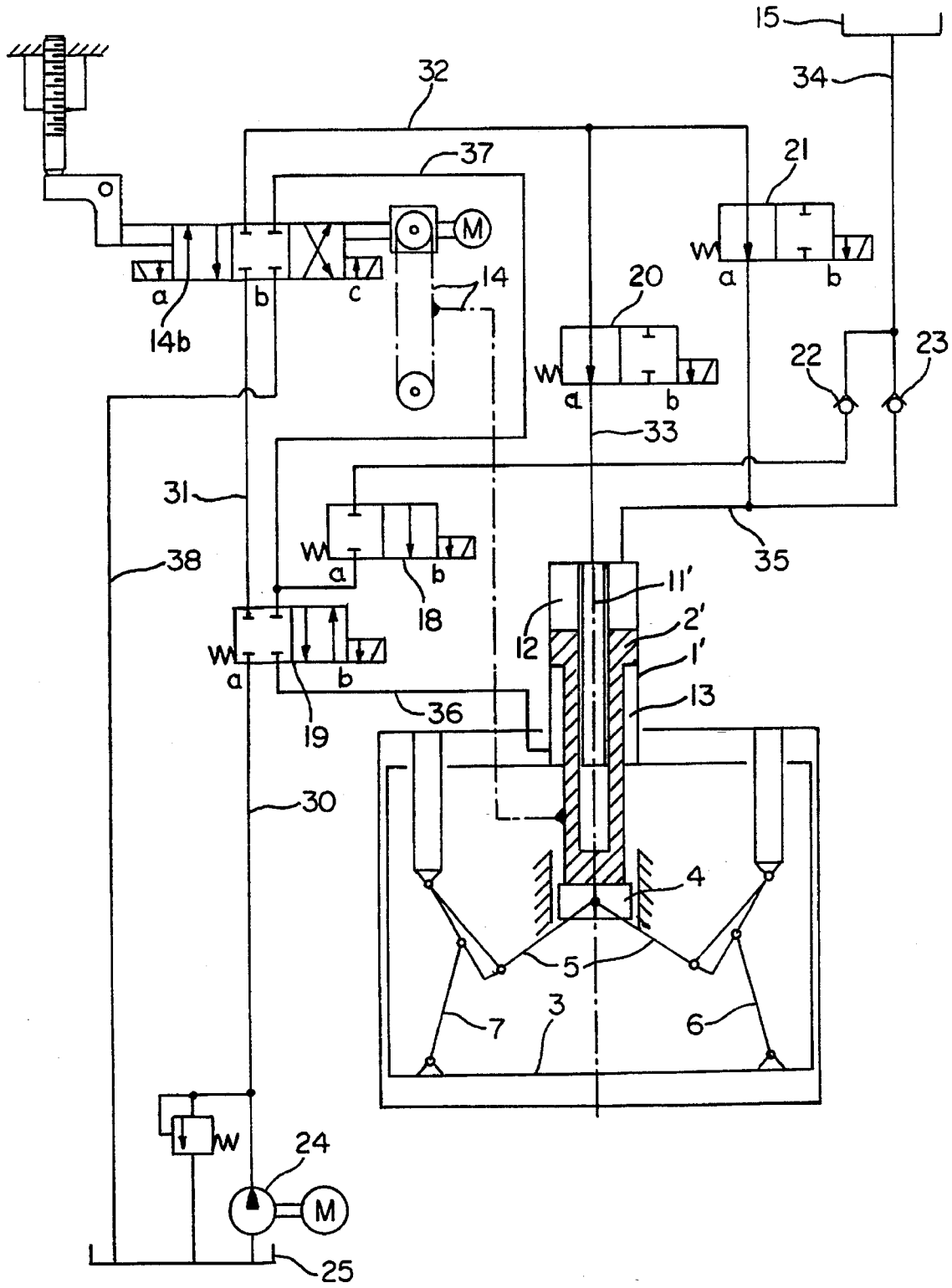
FIG. 6 shows a variant having separate simple valves.

Excess oil in the accumulator 18 (in the case of the upward movement of the ram 3) is transferred to the container 25 via pressure relief valve 52. FIGS. 4–6 show variance in which change-over occurs at upper dead center.

Compared with the solution according to FIG. 3, the variant according to FIG. 4 dispenses with the differential facility.

However, since the main principle of this system also corresponds to the system according to FIG. 3, only its key aspects will be described. The designation in parentheses after a reference symbol denotes the position of the corresponding valve.

Phase 1:

Hydraulic oil flows from pump 24 via line 30, valve 19 (b), line 31, valve **14*b* (a), line 32, valve 16*b* (c) and line 33 into cylinder space 11. Further oil from the container 15 is sucked or filled via line 34, valve 16*b* (c) and line 35 into the cylinder space 12. Oil is transported back from the cylinder space 13 via line 36, valve 19 (b), line 37, valve 14*b* (a) and line 38 into the container 25**.

Phase 2A:

Hydraulic oil flows from pump 24 via line 30, valve 19 (b), line 31, valve **14*b* (a), line 32, valve 16*b* (b), line 33 and 35 into the spaces 11 and 12**.

Oil flows back from cylinder space 13 via line 36, valve 19 (b), line 37, valve **14*b* (a) and line 38 into the container 25**.

Phase 2B:

Hydraulic oil flows from pump 24 via line 30, valve 19 (b), line 31, valve **14*b* (a), line 32, valve 16*b* (a) and line 35 into the cylinder space 12. Further oil is sucked or filled into the cylinder space 11 from the container 15 via line 34, valve 16*b* (a) and line 33. Oil flows back from the cylinder space 13 via line 36, valve 19 (b), line 37, valve 14*b* (a) and line 38 into the container 25**.

Phase 2C:

Hydraulic oil flows from pump 24 via line 30, valve 19 (b), line 31, valve **14*b* (a), line 32, valve 16*b* (c) and line 33 into the cylinder space 11. Further oil is sucked or filled into the cylinder space 12 from the container 15 via line 34, valve 16*b* (c) and line 35. Oil flows back from the cylinder space 13 via line 36, valve 19 (b), line 37, valve 14*b* (a) and line 38 into the container 25**.

Phase 3:

Hydraulic oil flows from pump 24 via line 30, valve 19 (b), line 31, valve **14*b* (c), line 37, valve 19 (b) and line 36 into the cylinder space 13. The oil displaced from the cylinder space 11 flows via line 33, valve 16b (c), line 32, valve 14*b* (c), line 38 into the container 25. The oil displaced from the cylinder space 12 flows via line 35, valve 16*b* (c) and line 34 into the container 15**.

The valve **14*b* may be in the form of a 4-edge controller (FIGS. 4 and 6) or a 2-edge controller 14*c* (FIG. 5). The valve 16*b* may be replaced in an embodiment according to FIGS. 4 and 5 by individual valves 20, 21, 22, 23 (corresponding to FIG. 6). Electrohydraulic actuation may be realized at the valves 16*b*, 20, 21 by mechanical actuation as a function of piston 2** by means of cams.

The valve 19 serves as a safety valve:

Position a: Press stop

Position b: Press in operation

Description of the embodiment according to FIG. 5 which, in contrast to the previous one, has auxiliary cylinders 44 for the upward movement, which are mounted in a stationary manner on the housing.

Note:

The hydraulically effective piston area in the cylinder space 11 is greater than the effective piston area in the cylinder space 13.

Phase 1:

Hydraulic oil flows from pump 24 via line 30, valve 19 (b), line 31, valve **14*c* (a), line 32, valve 16*b* (c) and line 33 into the cylinder space 11. At the same time, hydraulic oil is displaced from the cylinder space 13 and flows via line 36 and valve 18 (a) into line 31. Further oil is sucked or filled into the cylinder space 12 from the container 15 via line 34, valve 16*b* (c) and line 35**.

The oil displaced from the cylinders 44 flows via the lines 39 and 40, valve 19 (b), line 41, valve 17 (b) and line 42 into the tank 25.

Phase 2A:

Hydraulic oil flows from pump 24 via line 30, valve 19 (b), line 31, valve **14*c* (a), line 32, valve 16 (b), lines 33 and 35 into the cylinder spaces 12, 11. Oil flows back from the cylinder space 13 via line 36, valve 18 (b) and line 38 into the tank 25. The oil displaced from the cylinder space 44 flows via the lines 39, 40, valve 19 (b), line 41, valve 17 (b) and line 42 into the tank 25**.

Phase 2B:

Hydraulic oil flows from pump 24 via line 30, valve 19 (b), line 31, valve **14*c* (a), line 32, valve 16*b* (a) and line 35 into the cylinder space 12. Further oil is sucked or filled into the cylinder space 11 from the container 15 via line 34, valve 16*b* (a) and line 33. Oil flows back from the cylinder space 13 via line 36, valve 18 (b) and line 38 into the tank 25**.

The oil displaced from the cylinder 44 flows via the lines 39 and 40, valve 19 (b), line 41, valve 17 (b) and line 42 into the tank 25.

Phase 2C:

Hydraulic oil flows from pump 24 via line 30, valve 19 (b), line 31, valve **14*c* (a), line 32, valve 16*b* (c) and line 33 into the cylinder space 11. Further oil is sucked or filled into the cylinder space 12 from the container 15 via line 34, valve 16*b* (c) and line 35. Oil flows back from the cylinder space 13 via line 36, valve 18 (b) and line 38 into the tank 25**.

The oil displaced from the cylinder 44 flows via the lines 39, 40, valve 19 (b), line 41, valve 17 (b) and line 42 into the tank 25.

Phase 3:

Hydraulic oil flows from pump 24 via line 30, valve 19 (b), line 31, valve 18 (a) and line 36 into the cylinder space 13. At the same time, hydraulic oil flows from pump 24 via valve 17 (a), line 41, valve 19 (b) and lines 39, 40 to the cylinders 44.

The oil displaced from the cylinder space 11 flows via line 33, valve **16*b* (c), line 32, valve 14 (c) and line 38 into the tank 25. The oil displaced from the cylinder space 12 flows via line 35, valve 16*b* (c) and line 34 into the container 15. The upper chambers of the auxiliary working cylinders 44** are connected via their upper hydraulic space to the surrounding air.

The effective piston ring area of the annular space 13 is smaller than that of the effective cylinder space 11. The space 13 is continuously under pressure from the pump.

However, a forward movement is nevertheless possible owing to the above area ratios. The auxiliary working cylinders therefore support the backward movement, in order to compensate the small force of the small effective area in the annular space 13. At the beginning of the backward movement, the power of 13 is still completely sufficient since the lever transmission of the toggle levers still assists there. It is only toward the end the of backward movement that this support is necessary.

Description of the hydraulic circuit according to FIG. 6:

Note:

The hydraulically effective piston area in the cylinder space 11 is smaller than the piston area in cylinder space 13. Expressions in parentheses denote the position of the particular valves.

Phase 1:

Hydraulic oil flows from pump 24 via line 30, valve 19 (b), line 31, valve 14*b* (a), line 32, valve 20 (a) and line 33 into the cylinder space 11. Valve 21 is in position b. Further oil is sucked or filled into the cylinder space 12 from the container 15 via line 34, valve 23 and line 35. Oil flows back from the cylinder space 13 via line 36, valve 19 (b), line 37, valve 14*b* (a) and line 38 into the tank 25.

Phase 2A:

Hydraulic oil flows from pump 24 via line 30, valve 19 (b), line 31, valve 14*b* (a), line 32, valves 20 (a), 21 (a) and lines 33, 35 into the cylinder spaces 11, 12. Oil flows back from the cylinder space 13 via line 36, valve 19 (b), line 37, valve 14*b* (a) and line 38 into the tank 25.

Phase 2B:

Hydraulic oil flows from pump 24 via line 30, valve 19 (b), line 31, valve 14*b* (a), line 32, valve 21 (a) and line 35 into the cylinder space 12. Valve 20 is in position b. Further oil is sucked or filled into the cylinder space 11 from the container 15 via line 34, valve 22 and line 33. Oil flows back from the cylinder space 13 via line 36, valve 19 (b), line 37, valve 14*b* (a) and line 38 into the tank 25.

Phase 2C:

Hydraulic oil flows from pump 24 via line 30, valve 19 (b), line 31, valve 14*b* (a), line 32, valve 20 (a) and line 33 into the cylinder space 11. Valve 21 is in position b. Further oil is sucked or filled into the cylinder space 12 from the container 15 via line 34, valve 23 and line 35. Oil flows back from the cylinder space 13 via line 36, line 19 (b), line 37, valve 14*b* (a) and line 38 into the tank 25.

Phase 3A:

Hydraulic oil flows from pump 24 via line 30, valve 19 (b), line 31, valve 14*b* (c), line 37, valve 19 (b) and line 36 into the cylinder space 13. Valve 20 is in position b.

The hydraulic oil displaced from the cylinder space 11 flows via line 33 and valve 18 (b) into line 37. The oil displaced from the cylinder space 12 flows via line 35, valve 21 (a), line 32, valve 14*b* (c) and line 38 into the tank 25.

Phase 3B:

Hydraulic oil flows from pump 24 via line 30, valve 19 (b), line 31, valve 14*b* (c), line 37, valve 19 (b) and line 36 into the cylinder space 13. Valve 18 is in position a.

The oil displaced from the cylinder space 12, 11 flows via lines 33, 35, valves 20 (a), 21 (a), line 32, valve 14*b* (c) and line 38 into the tank 25.

The valves and lines described may be replaced by functionally similar components without departing from the scope of the invention, provided that the methods according to the invention are used.

The external structure of the press preferably comprises a two-stand frame partially closed at the front and face, according to the known differential travel press. A multi-joint lever design according to WO 87/07870 A1 may also be realized within the scope of the invention. Reference is herewith made to the relevant parts of the description in the cited publication.

I claim:

1. A method for hydraulic control of a piston rod of a working cylinder of a toggle lever system of a toggle lever press, comprising:

reducing velocity and increasing compressing force of a press ram prior to reaching a contact point at which a tool driven by said press ram contacts a work piece, and increasing forward movement velocity of said piston rod at least once after said contact point is reached and before initiation of backward movement of said piston rod.

2. The method according to claim 1, further comprising:

controlling forward and backward movement of said piston rod depending on travel of said press ram, and moving said piston rod at different velocities, as required during backward movement of said piston rod.

3. The method according to claim 2, in which said control step comprises controlling said forward and backward movement of said piston rod by mechanical control members.

4. The method according to claim 1, further comprising increasing forward movement velocity of said piston rod at least twice after said contact point is reached.

5. The method according to claim 1, wherein said velocity of said piston rod is varied by increasing or decreasing hydraulic force on different surface areas of said piston rod.

6. A toggle lever press having a controlled cylinder-piston arrangement comprising a control for hydraulically controlling a piston rod according to the method of claim 1.

7. The toggle lever press according to claim 6, wherein said cylinder-piston arrangement comprises at least one differential cylinder with at least one integrated plunger cylinder.

8. The toggle lever press according to claim 7, further comprising at least one working cylinder for backward movement of said press ram located beside said differential cylinder.

9. The toggle lever press according to claim 6, wherein said control includes a plurality of hydraulic valves and a distance-dependent feedback member that senses travel of at least one of said piston rod and said press ram to control said hydraulic valves, directly or indirectly.

10. The toggle lever press according to claim 6, wherein at least one cylinder of said cylinder-piston arrangement is firmly attached to said press ram.

11. The toggle lever press according to claim 6, further comprising:

at least one main working cylinder, and at least one auxiliary working cylinder located beside said at least one main working cylinder, firmly attached to a frame of said toggle press and having a piston rod connected to said press ram.

12. The toggle lever press according to claim 11, wherein said main working cylinder comprises a differential cylinder having an integrated plunger cylinder and a piston rod connected to toggle levers of said toggle lever press.

* * * * *